United States Patent [19]

Ganz et al.

[11] 4,289,236

[45] Sep. 15, 1981

[54] CASE CAN PACKAGE AND METHOD OF FORMING SAME

[75] Inventors: Robert H. Ganz, Saddle River; John H. Myers, Emerson, both of N.J.

[73] Assignee: Ganz Brothers, Inc., Bergenfield, N.J.

[21] Appl. No.: 79,050

[22] Filed: Sep. 26, 1979

[51] Int. Cl.[3] ..... B65D 75/38; B65B 53/02; B65D 85/62

[52] U.S. Cl. ..... 206/432; 206/45.33; 206/497; 206/459; 53/442

[58] Field of Search ..... 206/432, 497, 45.33, 206/161, 192, 459; 53/442

[56] References Cited

U.S. PATENT DOCUMENTS

| | | | |
|---|---|---|---|
| 3,515,272 | 6/1970 | von Gal | 206/161 |
| 3,933,244 | 1/1976 | Hughes et al. | 206/497 |
| 4,077,516 | 3/1978 | Duerr | 206/432 |

*Primary Examiner*—William T. Dixson, Jr.
*Attorney, Agent, or Firm*—Charles E. Brown

[57] ABSTRACT

This invention relates to a case can package wherein two twelve can-one-half case can packages are joined to form a one case can package by means of an overwrap. The package film of the one-half case can packages is provided on the outer surface thereof with a suitable overprint in the form of a resist which prevents bonding of the overwrap film thereto. The overwrap film interlocks with the cans of the two one-half case can packages to form a readily handleable one case package unit. The overwrap film is readily removable to present two one-half case can packages for individual sale. The overwrap joining the two one-half case can packages eliminates the need for the usual paper board tray, which is quite expensive, and at the same time provides for improved stacking of the can packages in case lots on pallets.

9 Claims, 3 Drawing Figures

SHRINK TUNNEL
SHRINK TUNNEL
CUT

CASE CAN PACKAGE AND METHOD OF FORMING SAME

This invention relates to new and useful improvements in can packages, most particularly beverage can packages.

At the present products packaged in cans in general and most specifically to beverages packaged in cans are sold in case lots. With respect to the beverage cans, the beverage cans are normally arranged in six-packs or twelve-packs and then are placed in paperboard trays for shipment as case lots.

It is has been found that when the individual can packages are of the shrink wrap type wherein a shrinkable plastic film is wrapped around the cans and then beat shrunk, and the can packages are packed within a tray followed by stacking of the case lot trays on pallets, the overlying tray cooperates with the upstanding seams or chimes of underlying cans in a manner to function generally as a cookie cutter, i.e. the tray serves in conjunction with the can to sever the plastic film, thereby damaging the packages. Also, at the present in many instances the plastic film bears on the underside thereof pricing indicia. It has been found that this pricing indicia, which is printed on the plastic film, when it rubs on the paperboard tray during shipment frequently rubs offs so as to be unusable. Finally, it has been found that the relatively slippery plastic film, when contacted by an overlying paperboard tray does not provide for suitable stacking at an effective height in that there is little frictional engagement between the plastic film and the paperboard tray.

Applicant has proposed in the past and has devised machinery wherein beverage cans, in particular, are packaged in twelve packs wherein four columus of cans in three rows each are wrapped by a plastic film which is then shrunk about the cans to form a readily handleable package. In the past two of these twelve packs have been seated in each paperboard tray to form a case. In accordance with this invention, it is proposed to eliminate the tray and to combine the two twelve packs, one-half case can packages, into a one case can package by means of a plastic film overwrap. The use of such a plastic film overwrap forming the two one-half case can packages into a one case can package provides for numerous advantages. First of all, the cost of utilizing an overwrap to convert two one-half case can packages into a case can package is on the order of forty dollars per thousand cases cheaper than the use of paperboard trays. Secondly, because the indicia on the package films are protected by the overwrap film, the pricing indicia and other indicia, such as labels, is not damaged during shipment. Finally, although there are four layers of plastic film material between stacked cans, the configuration of present two piece cans is one wherein the tapered bottom of an overlying can will nest within the recessed upper end of an underlying can. The four layers of plastic film provide a proper cushioning while still permitting the interlock. Thus, the one case can packages formed in accordance with this invention are more suitable for palletizing than prior one case can packages utilizing cardboard trays.

With the above, and other objects in view that will hereinafter appear, the nature of the invention will be more clearly understood by reference to the following detailed description, the appended claims and the several views illustrated in the accompanying drawings.

Figures 1, 2, 3:
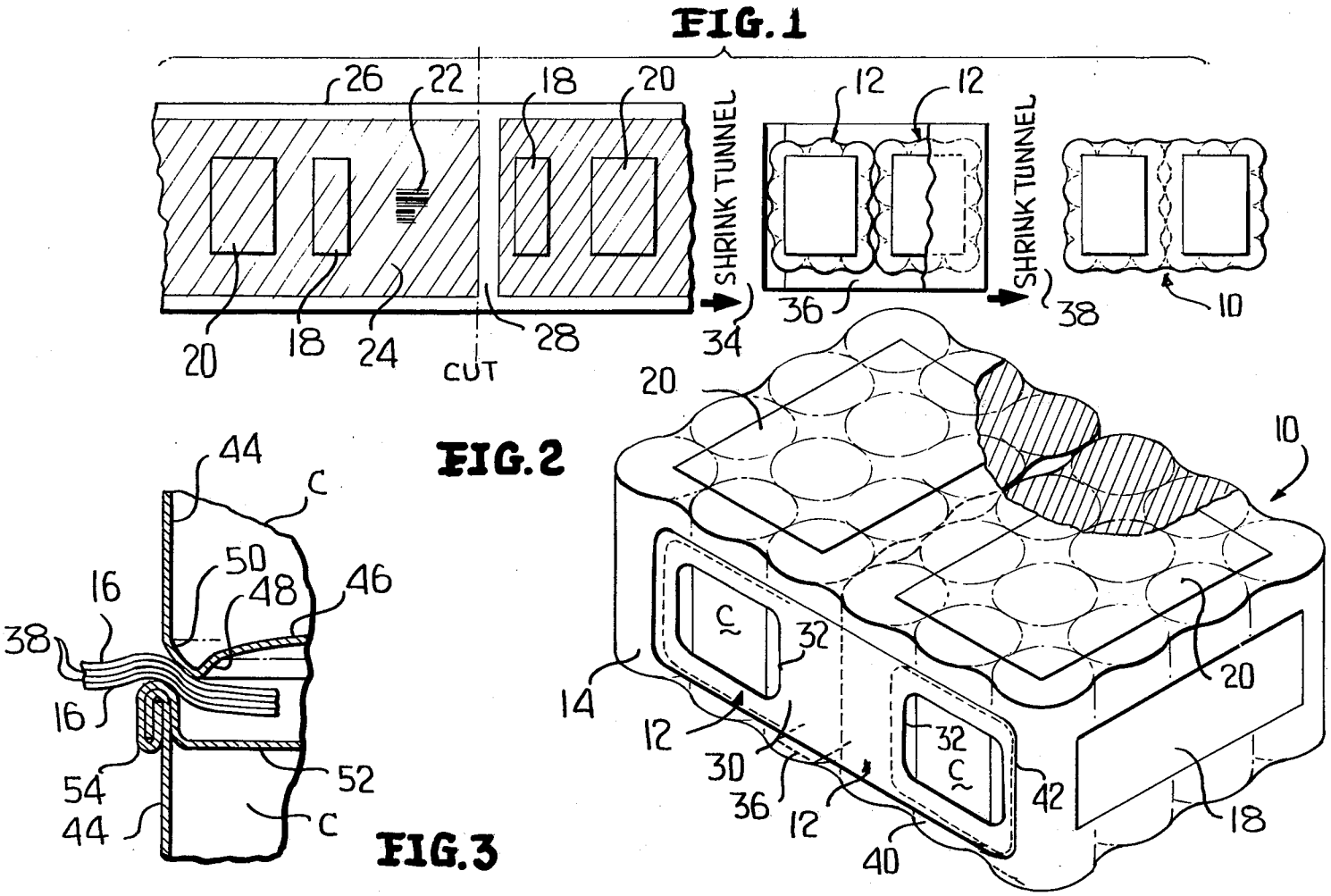
FIG. 1 is a schematic view showing the sequence of forming a one case can package in accordance with this invention.
FIG. 2 is an enlarged perspective view of a one case can package and shows the specific constructional details thereof.
FIG. 3 is an enlarged fragmentary sectional view showing the manner in which two stacked cans, wrapped in separate can packages, will internest while at the same time not unduly placing a shearing load on the intermediate plastic films.

Referring now to the drawings in detail, it will be seen that there is illustrated in FIG. 3 a one case can package formed in accordance with this invention, the can package being generally identified by the numeral 10. The can package 10 is basically formed of two one-half can packages 12 which are disposed in side by side relation and which are joined together by a plastic film overwrap 14. Except for certain minor improvements, the can packages 12 are of a conventional construction.

The can packages 10 and 12 are formed from a continuous plastic film which shrinks when heated and are automatically formed by conventional packaging machinery which is not a part of this invention. Typical machinery includes that disclosed in applicant's U.S. Pat. No. Re. 28,535 granted Sept. 2, 1975; applicant's prior U.S. Pat. No. 4,083,163 granted Apr. 11, 1978 and other similar machinery later developed by applicant.

In accordance with this invention, a package film 16 is provided on a continuous basis and has imprinted thereon a top label 18, side labels 20 and pricing indicia 22. A typical plastic film for the package film 16 would be polyethylene having a three mil thickness.

The package film 16 is provided with an overprint 24 which functions as a resist. While numerous overprints, including varnishes, will serve the purpose, applicant has had particular success with THERMO PRINT GK OVERPRINT #5-GK-2033 distributed by DEL-VAL INK AND COLOR P.O. Box 187, 1301 Taylor Lane, Riverton, N.J.

The overprint or resist 24 is in the central portion only of the web from which the package film 16 is formed leaving along opposite sides of the package film 16 uncoated side edges 26. In addition, a transverse area 28 is uncoated. This transverse area is that area wherein a bond is formed between the lapped portions of the package film 16 when applied to a cluster of cans.

In accordance with this invention, the continuous web forming the package film 16 is wrapped around twelve cans C which are arranged in four columns and three rows each. As is clearly shown in FIG. 1, the package film 16 is of a width greater than the width of the four cans C so that when the package wrap 16 is applied to the twelve cans, the material projecting beyond opposite ends of the can cluster is drawn inwardly to form at each end of the can package 12 an end wall 30 having a central opening 32 therein. For example, the width of the package film for wrapping four wide can clusters having a width of 10½ inches will be on the order of 15 inches.

After the package wrap film 16 has been applied to a cluster of twelve cans C, the wrapped cans pass through a conventional shrink tunnel schematically designated in FIG. 1 and identified by the numeral 34 to both form an overlapped bond 36 between bottom panels of the package film and to effect the shrinkage of the package film around the cans to form the can package 12.

Two can packages 12 are then disposed in side by side relation to form a can arrangement which is four by six. The two can packages 12 are then wrapped in the same manner by an overwrap film 36 which is clear and preferably formed of the same material as the package film 16 but of a 2 mil thickness. Further, the overwrap film 36 would normally have a width of 12½ inches.

The so wrapped can packages 12 then pass through a second shrink tunnel which is schematically illustrated and designated by the numeral 38 both to bond overlapped bottom panel portions of the overwrap and to shrink the overwrap film 36 about the can packages 12.

It is to be understood that the width of the overprint or resist 24 is greater than the width of the overwrap film 36. For example, the uncoated side stripes 26 are preferably one inch wide.

Because the overwrap film is 2½ inches less in width than the package film, it will be seen that when it shrinks about the can packages 12, it will form at opposite ends of the can packages 12 an end panel 40. The end panel will have an enlarged opening 42 formed therein with the opening 42 being generally aligned with the openings 32 and of both a greater height and a greater width.

If the overwrap 14 is perfectly aligned with the can packages 12, there will be no bonding whatsoever of the overwrap film 36 to the package films 16. However, the overwrap film 36 does have a slight tendency to shift relative to the package films 16 in a transverse direction. In order to minimize slippage, the uncoated stripes 26 are provided. As soon as the overwrap film 36 shifts too far to one side, an edge portion thereof will contact the uncoated stripe 26 and bonding will occur preventing further shifting of the overwrap film.

At this time it is pointed out that although the invention has been specifically described with respect to the separate forming of two can packages 12 and then the formation of those two can packages into a further case can package 10, it is to be understood that it is feasible to first individually wrap two clusters of twelve cans each with the plastic films 16 moving the wrap over a hot plate to seal the overlaps and then prior to heat shrinking of the package films 16, wrapping the two wrapped clusters with the overwrap film 36. Then a single heat shrinking of the films may simultaneously occur. The net result would be the elimination of the shrink tunnel 34 and the utilization of only the shrink tunnel 38.

Reference is now made to FIG. 3 in particular wherein there is illustrated the relationship of two of the beverage cans C in stacked relation even though separated by two package films 16 and two overwrap films 36. It is to be noted that the cans C are of the two piece type and include a body 44 having an integral bottom 46 joined thereto by an integral annular rib like portion 48 which includes a downwardly and inwardly tapering outer portion 50. The upper end of the can body 44 is closed by a conventional end panel 52 secured to the can body by means of a conventional double seam 54. The end panel 52 may be of the easy opening type although the opening tab is not illustrated.

The respective diameters of the bottom and upper portions of the can C is such that there is a slight internesting of the rib 48 into the recess defined by the double seam 54 and the end unit 52. The net result is an interlocking of the cans with the cans being cushioned by the 10 mil total thickness of the films 16 and 36. The net result of this interlock is that there is no shifting between vertically adjacent can packages 10 and thus the can packages 10 may be stacked on a pallet and shipped much better than the presently utilized paperboard tray arrangements. Further, the overwrap 14 protects all of the indicia and labels on the can packages 12. Finally, the overwrap 14 may be readily removed from the two can packages 12 leaving them intact for individual sale.

Although both the resist 24 and the indicia and labels have been described as being on the outer surface of the package film 16, the indicia and labels may be on the inner surface of the package film 16. Further, when the indicia and labels are on the inner surface of the package film 16, it may be more desirable to place the resist 24 on the inner surface of the overwrap film 36.

Although only a preferred embodiment of the case can package has been specifically illustrated and described herein, it is to be understood that minor variations may be made in the case can package and the method of forming the same without departing from the spirit and scope of the invention as defined by the appended claims.

We claim:

1. A method of packaging cans of products in case lots, said method comprising the steps of arranging cans forming a one-half case in rows and columns, wrapping said one-half case of cans in a package forming film and heat shrinking the film about the cans to form a one-half case package, repeating the above steps to form a like one-half case package, arranging the two one-half case packages in aligned adjacent relation, providing an overwrap film, applying a resist selectively to said package forming films, wrapping the two one-half case packages in an overwrap film, and heat shrinking the overwrap film about the two one-half case packages without substantial bonding of the overwrap film to the package film due to the presence of the resist to form a case package, the overwrap film being of a width less than the package film, and opposite longitudinal edge portions of the package film being free of the resist for a distance slightly less than one-half the differences in width, wherein transverse shifting of the overwrap film relative to the package film may be prevented by bonding of an edge portion of the package film.

2. The method of claim 1 wherein the package film is provided as a continuous web and the resist is applied to the package film while in web form.

3. The method of claim 1 wherein all of said films are heat shrunk at the same time.

4. A case can package comprising two one-half case can packages disposed in side by side relation, said one-half case can packages being identical and each one-half case can package including cans arranged in rows and columns and a package film surrounding said cans and shrunk tightly around said cans in interlocking relation therewith to form a readily handleable unit, and an overwrap film surrounding two one-half case can packages and shrunk tightly around said one-half can packages in interlocking relation therewith to form a readily handleable case can package, and a selected one of said package film and said overwrap film having a surface with a resist coating thereon opposing the other of said films and substantially preventing bonding of said overwrap film to said package films whereby said overwrap film is readily removable from said one-half case can packages without damaging said package films, the package film of each of said one-half case can packages defining at opposite ends thereof an open area, and said overwrap film defining at opposite ends of said case can package a similar opening generally aligned with said package film openings and of a greater height and width.

5. A case can package according to claim 4 wherein said resist is on the outer surface of said package films.

6. A case can package according to claim 5 wherein said package film surrounding said openings at the end thereof are free of said resist.

7. A case can package according to claim 5 wherein said package film surrounding said opeings at the end thereof are free of said resist, and there is a limited bonding of one end of said overwrap film to said package films.

8. A case can package in accordance with claim 4 wherein said cans have tapered bottom portions and recessed top portions, and cans of stacked ones of said cases are internested while being separated by said package films and said overwrap films to facilitate stacking.

9. A case can package according to claim 4 wherein each of said package films bear labels and pricing indicia.

* * * * *